United States Patent [19]

Collins

[11] 4,019,168

[45] Apr. 19, 1977

[54] BILAYER THIN FILM RESISTOR AND METHOD FOR MANUFACTURE

[75] Inventor: Franklyn M. Collins, Lewiston, N.Y.

[73] Assignee: Airco, Inc., Montvale, N.J.

[22] Filed: Aug. 21, 1975

[21] Appl. No.: 606,399

[52] U.S. Cl. ..... 338/309; 204/192 F; 338/195; 338/327; 427/103; 427/123; 427/126; 428/539

[51] Int. Cl.[2] ..... H01C 1/012

[58] Field of Search ..... 338/306–309, 338/195, 327; 204/14, 15, 192 FR, 192 EC, 192 E; 427/102, 103, 123, 125, 126; 428/901, 539

[56] References Cited

UNITED STATES PATENTS

| | | | |
|---|---|---|---|
| 3,512,254 | 5/1970 | Jenkins et al. | 338/195 X |
| 3,607,476 | 9/1971 | Besamat et al. | 204/192 FR X |
| 3,622,410 | 11/1971 | Carlson | 204/192 FR X |
| 3,833,410 | 9/1974 | Ang et al. | 204/192 FR X |
| 3,864,825 | 2/1975 | Holmes | 338/308 X |

*Primary Examiner*—C. L. Albritton

*Attorney, Agent, or Firm*—Edmund W. Bopp; Larry R. Cassett

[57] ABSTRACT

A composite thin film resistor is disclosed, including an electrically inert substrate upon which is deposited a nickel-chromium alloy thin film, and an overlying second thin film — which is initially deposited as metallic tantalum. In the final product the tantalum is passivated, as by thermal oxidation, so that the said film is substantially tantalum oxide throughout, except where such film underlies a pair of conductive terminal pads. The terminal pads are spaced on the substrate, so that the resistive path therebetween is defined through the nickel-chromium thin film — via the thin metallic tantalum film interfacing between the nickel-chromium film and conductive pads. The overlying tantalum oxide provides a very high degree of environmental protection with respect to the Ni—Cr film, whereby the product not only displays the desirably low TCR characteristics of Ni—Cr, but is also highly resistant to moisture and other environmental factors. The product also exhibits outstanding resistance to the adverse effects of electrolysis supported by the presence of moisture. The various films, including a gold film from which the terminal pads are derived, may be deposited upon the inert substrate by sequential sputtering during a single evacuation of a vacuum chamber. Desired resistive patterns may then be formed by photoetching, subsequent to which oxidation of accessible portions of the tantalum film can be effected by heating in an appropriate atmosphere.

15 Claims, 7 Drawing Figures

BILAYER THIN FILM RESISTOR AND METHOD FOR MANUFACTURE

BACKGROUND OF INVENTION

An entire branch of the science of hybrid microelectronics is based upon the use of thin film materials deposited in vacuum on insulating substrates. Surfaces of this type are generally constructed by the deposition of separate conductive and resistive films, with desired patterns thereafter being generated by the use of photo-lithographic techniques, e.g. by selective photo-etching of the various layers so as to achieve the desired patterns of resistors and conductors.

A class of materials often employed as a resistive material, are the nickel-chromium alloys, e.g. those compositions commonly known to those skilled in the art, under the trademark "Nichrome". These materials have a long history of utilization in thin film hybrid circuitry. They are most noteworthy in exhibiting a low temperature coefficient of resistivity (TCR); and under most conditions of operation, very high stability. A most serious drawback however is their vulnerability to corrosive degradation under certain environmental circumstances; e.g. under certain conditions, such as in the presence of moisture and an electrical bias, the thin nickel-chromium (hereinafter sometimes referred to as Ni—Cr) films can be impaired by electrolytic attack.

From time to time proposals have been made for armoring the Ni—Cr thin films to achieve supplemental protection against environmental effects. For example, in Alger U.S. Pat. No. 3,112,222, an overcoating of titanium oxide is provided for such purposes. In practice, however, it is found that protective layers of materials such as silicon monoxide or the titanium oxide mentioned, are less than fully effective, particularly when exposed to moisture. In particular this type of protective layer tends to be relatively lacking in continuity by virtue of pin holes and other undesirable inclusions. Furthermore, it is necessary to in some manner effect electrical connection to the Ni—Cr layer, in order to define a resistive path between conductor terminals; and difficulties are commonly encountered in effecting such connections where the nature of the armor layer is not physically and electrically compatible with the nickel-chromium alloy.

The material tantalum is widely known for use in resistors in thin film microcircuits application, particularly in the form of tantalum nitride. Thin films of this type are characterized in general by their overall stability and reliability and in particular by an exceptional ability to successfully withstand corrosive attack. While the environmental characteristics of the tantalum-based materials are therefore excellent, the materials have been deemed less than ideal for use as resistive elements, primarily because of their relatively high TCR. Whereas nickel-chromium films can be readily prepared with a TCR of less than ±25 ppm/C°, tantalum nitride is difficult to fabricate with a TCR of less than 100 ppm/C°.

It has also been proposed in the art, to fabricate thin film resistors in the form of multi-layer structures, wherein the various layers each serve a resistive function, i.e. as opposed to the instance where an upper layer is protective in nature. For example, in U.S. Pat. No. 3,864,825, a thin film resistor structure is disclosed, wherein layers of resistive materials are superimposed upon an area of the substrate. The said patent teaches that the materials of highest resistivity be deposited adjacent to the substrate, with the remaining layers being in the order of decreasing resistivity. It is shown in this patent, that by such an arrangement one may selectively remove one or more of the various layers, so that the equivalent resistance of the remaining layers has a specific value of interest for a given application.

In accordance with the foregoing, it may be regarded as an object of the present invention, to provide a composite thin film resistor structure, which displays the desirable thermal stability characteristics of the nickel-chromium alloys, while yet being exceedingly resistant to environmental attack.

It is a further object of the present invention to provide a composite thin film resistor, and method for manufacture thereof, wherein the advantages of the nickel-chromium thin films with respect to the thermal stability properties, are combined with the environmental-resisting characteristics of tantalum-derived thin films.

SUMMARY OF INVENTION

Now in accordance with the present invention, the foregoing objects, and others as will become apparent in the course of the ensuing specification, are achieved in a composite thin film resistor structure, which includes an electrically inert substrate upon which is deposited a nickel-chromium alloy thin film. A second thin film is overdeposited upon the Ni—Cr film, and a pair of conductive terminal pads are provided in overlying relationship to the second film, the pads being spaced with respect to one another on the substrate. The second thin film, while initially deposited as metallic tantalum, is in the final product of the invention oxidized, so that such film is in the form of tantalum oxide substantially throughout its entire thickness — except at the interface area between the conductive pads and nichrome. In this latter area the film remains in the form of metallic tantalum, to thereby provide an effective low resistance conductive path between the terminal pads and the Ni—Cr film — the latter basically constituting the resistive element. The overlying layer of tantalum oxide is substantially inert and electrically insulating, and is found to provide outstanding protection for the underlying nickel-chromium film. In consequence, the said product displays exceptional stability under all environmental conditions of interest, such as during thermal cycling, and in the presence of moisture and an electrical potential.

In the preferred method for producing the said product, the nickel-chromium layer is deposited on an insulating substrate by sputtering although other vacuum deposition techniques may be used. While maintaining the vacuum, a tantalum layer of a desired thickness is thereupon deposited on the nickel-chromium layer, with a gold layer being successively deposited so as to enable terminal formation. Photo-etching techniques as are known in the art, are thereupon employed for forming the terminal pads; and for providing a desired resistive pattern. Thereafter the device is passivated, by subjecting the structure to a treatment which oxidizes the overlying tantalum film substantially throughout its depth — except at the intervening space between contact pads and the nickel-chromium film, where the layer remains as metallic tantalum. The oxidation process is preferably effected by a thermal treatment in a suitable atmosphere, although other methods as are known in the art, such as anodization, may also be used.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
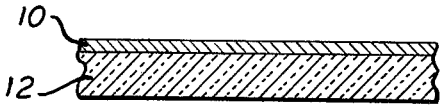
FIGS. 1 through 6, schematically illustrate successive process steps in the formation of a composite thin film resistor in accordance with the invention.

Referring now to the schematic cross-sectional view of FIGS. 1 through 6, sequential process steps are set forth which illustrate the manner in which a resistor product in accordance with the present invention may be prepared.

Initially a thin film 10 of a nickel-chromium alloy is vacuum-deposited upon an inert substrate 12, the latter being of any conventional materials as are utilized in the microelectronics arts, such as glass, passivated silicon, alumina, sapphire, or various ceramic and passivated ceramic materials as are known to be useful for the present purposes. The nickel-chromium film may be deposited by any conventional vacuum deposition techniques, including by thermal evaporation; however, it is preferred to apply the film 10 by sputtering, using either D.C. or R.F. techniques, as are known in the art. The thin film thus provided will typically have a thickness of the order of 50 to 1000A. The actual thickness of the film will be in accord with the desired resistive properties of the resultant film. For example, utilizing a glass substrate, the film 10 with representative alloys of the type mentioned, will preferably have a thickness in the range of from about 100 to 500A, which in general will correspond to final resistive values of the order of 400 to 50 ohms per square.

The nickel-chromium alloys utilized for present purposes are those conventional in the art, which typically include a nickel content of 30 to 90% by weight, with the balance of the composition being chromium. The nickel-chromium alloys widely known in the art under the trademark "Nichrome" are all suitable for present purposes; and other nickel-chromium alloys including fractional percentages of other metals, such as iron, may also be utilized for film 10. It is contemplated further that a cobalt-chromium alloy having no significant amount of nickel can also serve as the underlying conductive film in place of the Ni—Cr film.

In accordance with the second successive step of the inventive method, a second thin film 14 of metallic tantalum is overdeposited upon the nickel-chromium film 10. This is once again effected by vacuum deposition techniques (preferably by sputtering); and indeed one of the advantages of the method of the present invention is that the tantalum layer (and the subsequent gold layer) may all be deposited by successive steps without breaking the vacuum while the substrate 12 remains continuously in the same vacuum chamber. This is to say that no requirement exists in the present invention for disrupting the vacuum conditions initially established in the chamber in which the substrate is placed.

The tantalum thin film 14 is typically deposited to a thickness of the order of 100 to 1000A. Since the tantalum, as mentioned, is deposited in the same apparatus as are the other metallic films, it is also possible, but not necessary to the invention, to blend the interface between successive films; which is to say, that if desired, one can produce a blended compositional gradient at the interface zone 16 by providing for a slow changeover from one metal film to another, i.e. by techniques known in the art, such as by adjusting the bias potentials provided to plural targets.

As will become increasingly apparent in the ensuing paragraphs, the tantalum film 14 which, as deposited is of commercial purity, serves a variety of functions in the ultimate product. Thus aside from its function as a protective layer (i.e. after passivation thereof), the metallic tantalum serves as a diffusion barrier and provides a good conductive interface between the nickel-chromium film 12 and the conductive terminals — which are ultimately derived from a gold film.

Figure 3:
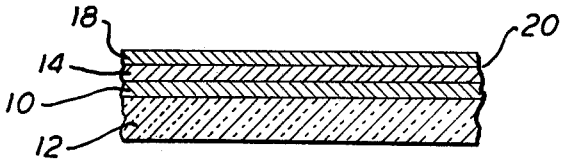

In particular there is next seen in FIG. 3 to be overdeposited atop the metallic tantalum film 14 a film 18 of gold. Gold film 18 may once again be initially deposited as a thin film, e.g. by vacuum techniques including thermal evaporation and by sputtering from a suitable target. In a preferable procedure, the gold film may be so deposited to a thickness of from a few to several thousand A, after which the gold film may be thickened to as much as 50 microinches or more by a conventional electroplating technique. The latter procedures enable a faster and more economical process, in the course of producing the relatively thick gold layer which will ultimately provide terminal pads for the resistor structure.

Figure 2:
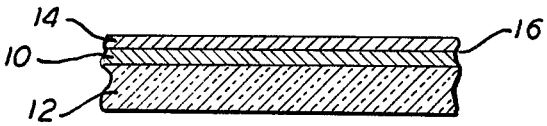

As has been previously noted in connection with the discussion of FIG. 2, the interface 20 between gold film 18 and tantalum film 14 may be sharply defined or may be formulated as a gradual transition from one metal to the other, by utilizing the techniques previously mentioned.

In the next sequential step of the process utilized herein, the completed basic structure is subjected to a standard photo-etching technique in order to establish a desired pattern for the gold which will constitute the conductive terminals for the ultimate resistor structure. Thus in FIG. 4 there is schematically illustrated a pair of island-like pads 22 and 24, which are derived from gold layer 18 by standard photo-etching techniques. Thus, as known in the art, the structure of FIG. 3, after being overcoated with a photo-resist is subjected to an optical pattern of actinic radiation, which polymerizes the resist over those areas which are not to be etched. The resist is removed from unpolymerized areas and the underlying portions of the gold film etched away, to ultimately leave the islandlike terminals shown in the Figure (i.e. following subsequent removal of the polymerized resist layer). The etching of the gold layer in the present instance is effected utilizing an etching composition that will dissolve gold, but not attack the underlying tantalum layer, such as, for example a potassium iodide-iodine solution.

Figure 4:
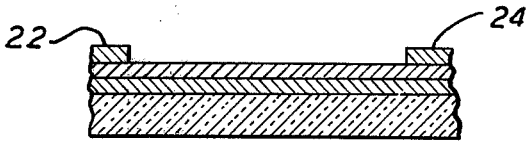

It will, of course, be understood that in the cross-sectional depiction of FIG. 4 only a single pair of terminals 22, 24 can be seen; whereas in reality a number of such paired terminals may be provided, each pair of which will serve as terminals for resistors formed in the manner which is herein set forth.

Following the etching of the gold film, the tantalum film 14 and the underlying nickel-chromium film 10, are selectively etched, by substantially the same well-known process as previously described, so as to remove from the substrate all portions of the films except those associated with the desired resistor pattern. This can be effected by well-known techniques, e.g. by two-step selective etching, using a first etchant for the tantalum, and then a second etchant for the nickel-chromium film. suitable compositions for this purpose may, for example, be nitric-hydrofluoric acid and potassium permanganate-sodium hydroxide solutions respectively.

Figure 5:
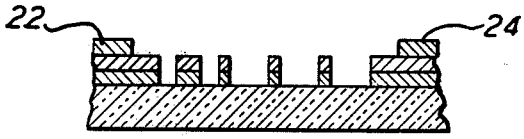
Figure 6:
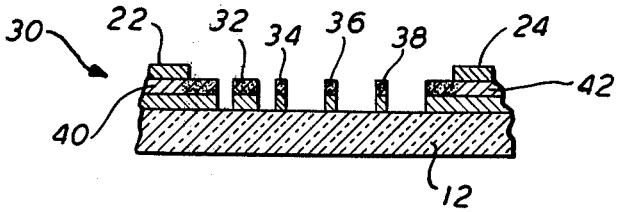
Figure 7:
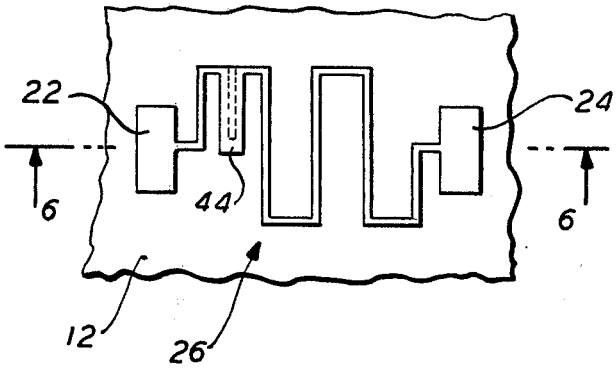
FIG. 7 is a partial plan view of the product produced by the process of FIGS. 1 through 6, the relationship being such that FIG. 6 is taken along the line 6—6 of FIG. 7.

As a result of the foregoing process, the product now assumes the form shown in the FIG. 5 cross-section — which may be better understood by reference to FIG. 7. Although the latter Figure shows the finished product of FIG. 6 in plan, the geometric arrangement of the pattern at FIG. 5 already corresponds to that of FIG. 6, i.e. the pair of conductive terminals 22 and 24 are joined by a tortuous pattern 26, which will ultimately define the resistive path between the conductive terminal pads.

The procedures discussed in connection with FIGS. 4 and 5 may, if desired, be replaced by an alternate technique, according to which gold film 18 may as a first step be selectively photo-etched from all portions of the structure, with the exception of the terminal areas and the underlying areas which will ultimately define the resistor pattern. The structure may then be sputter-etched until the tantalum and nickel-chromium films are removed in all areas where not covered by gold. This technique also removes some gold; but since the gold is considerably thicker than the other two films the tantalum film 14 lying under the gold layer is not exposed. Thereupon the remaining gold layer may be selectively photo-etched from the resistor portions of the pattern — while remaining in place at the terminal portions, i.e. corresponding to the pads 22 and 24 previously discussed.

Following the sequence of steps so far discussed, the structure of FIG. 5, now carrying the basic resistive pattern, is subjected to passivation to yield the product 30 shown schematically in FIG. 6. In accordance with this aspect of the invention, the entire structure of FIG. 5 is subjected to a treatment, the purpose of which is to oxidize the tantalum so that the portions accessible to such treatment are converted throughout the depth of film 14 to the form of tantalum oxide — which is a substantially inert, and electrically insulating compound. This operation is preferably effected by thermal oxidation, e.g. by baking the structure 30 in air at temperatures of the order of 400° C for time periods of the order of 30 to 120 minutes.

The result of such an oxidation step is suggested in the schematic view of FIG. 6, where the cross-hatching of film 14 as at 32, 34 and 36 and 38 is intended to indicate that film 14 in these volumes has been converted throughout its thickness, to the form of tantalum oxide.

In this connection it should be especially noted that the portions 40 and 42 of tantalum film 14 residing between the conductive pads 22 and 24 and the nickel-chromium film 10, have remained as metallic tantalum. This is a highly significant aspect of the present invention in that by enabling film 14 to remain in its metallic condition at the zones indicated, the advantages of the tantalum interface — i.e. the conductive and diffusion barrier functions previously mentioned — are fully maintained.

A plan view of the completed resistor structure 30 of FIG. 6, is shown in FIG. 7, which, of course, is only partial (i.e. a number of resistors may typically be present on a single substrate 12). The tortuous resistive pattern 26 extending between conductive terminal pads 22 and 24 define the basic resistor — which actually constitutes, however (as shown in FIG. 6), the nickel-chromium film 10. This is to say that a particular resistor on substrate 12 is defined by the path which includes conductive pad 22, the underlying portion 40 of metallic tantalum, the tortuous path 26 of nickel-chromium, the portion 42 of metallic tantalum, and the conductive pad 24.

The resistive path 26 may also include a trimming tap 44 (FIG. 7), which trimming tab may be partially removed (broken lines, FIG. 7) by means of a laser or other film removing device, as is known in the art, for rendering the final adjustment to a resistor.

The finished structure 30 of FIG. 7, may be utilized in microelectronic applications in its as shown form; or may be subjected to further known methods. For example leads may be suitably attached to the terminal portions such as at 22 and 24, and the structure may then be packaged in an encapsulating medium. It will also be understood by those familiar with the microelectronics art that the substrate 12 can in essense constitute a discrete component, the function of which is purely resistive in purpose; or the substrate 12 can include various other microelectronic devices commonly mounted on the substrate and interconnected with the resistive pattern.

The products disclosed herein, and as shown, for example, in FIGS. 6 and 7, have been found to display exceedingly stable electrical properties when subjected to the standard testing procedures used in the microelectronics industries. In a typical testing procedure, for example, a structure was produced which included six resistors of the general type set forth in the plan view of FIG. 7. Thus six resistors were provided on a single 60 mil square silicon chip substrate, which substrate was initially provided with a passivating layer of silicon dioxide. The nickel-chromium alloy used in forming the resistors had a nominal resistance of 100 ohms per square; and the six resistors had a range of values from approximately 0.77 to about $8.82 \times 10^4$ ohms.

The product carrying the six resistors was subjected to a series of standard tests intended to determine variation in measured resistance as a result of thermal shock, of temperature cycling, and of temperature cycling interposed with applied moisture. With one exception (where the resistive value was found to vary by 0.1% from the initial value — following 10 cycles including moisture subjection), all of the six resistive patterns subjected to the standard industry tests, showed substantially no variation in their resistive properties as a result of the testing procedures.

In addition to the standard industry tests above described, resistive patterns of the type shown in FIG. 7 have been subjected to so-called "water-drop tests". Such tests have been devised within the last several years for examining the effects of corrosion, oxidation and inter-diffusion on thin film resistors such as nickel-chromium thin film resistors. In a typical test of this type, a drop of water is placed in overlying relationship to a nickel-chromium film resistor, and a biasing voltage is applied across the terminals of the structure. The structures are then examined after a pre-determined period of time in an effort to determine the presence of corrosion e.g. due to anodic dissolution. Further details regarding tests of this type are reported e.g. in a paper entitled "Further Studies on the Reliability of Thin Film Nickel-Chromium Resistors" by Wayne M. Paulson, 11*th Annual Proceedings — Reliability Physics* (1973). The resistive products of the present invention when subjected to a series of tests of the type discussed, showed no evidence whatsoever of any structural deterioration.

While the present invention has been particularly set forth in terms of specific embodiments thereof, it will be understood in view of the present disclosure that numerous variations upon the invention are now enabled to those skilled in the art, which variations yet reside within the scope of the instant teaching. Accordingly the invention is to be broadly construed, and limited only by the scope and spirit of the claims now appended hereto.

I claim:

1. An electrical resistor comprising a non-conductive substrate, a conductive thin film of a chromium containing alloy selected from the group consisting of nickel-chromium and cobalt-chromium supported thereby and a protective layer of tantalum oxide directly thereover and contiguous therewith.

2. An electrical resistor according to claim 1 in which the conductive thin film is nickel-chromium.

3. A composite thin film resistor structure, comprising in combination:

an electrically inert substrate;

a chromium alloy thin film deposited upon said substrate;

a second thin film being overdeposited upon said chromium alloy film;

at least a pair of spaced conductive terminal pads being overdeposited upon said second film;

said second film comprising metallic tantalum at portions thereof residing between said pads and said chromium alloy film; and said second film comprising oxidized tantalum at the portions thereof extending between said terminal pads; said oxidized tantalum being contiguous with said chromium alloy film and providing a relatively inert protective layer with respect to said underlying chromium alloy film; and a resistive path for said structure being defined between said terminal pads by said metallic tantalum portions and the intervening path through said chromium alloy film.

4. A device in accordance with claim 3 wherein said chromium alloy is nickel-chromium.

5. A device in accordance with claim 4, wherein said conductive terminal pads comprise metallic gold.

6. A device in accordance with claim 4, wherein said films are photo-etched to define said resistive path upon said substrate.

7. A device in accordance with claim 4, wherein said films are etched to define a plurality of discrete resistive paths, and further including a plurality of said pairs of conductive pads, one each of said pairs being associated with each said discrete path.

8. A device in accordance with claim 4, wherein said second film has a thickness in the range of from about 100 to 1000A.

9. A device in accordance with claim 4, wherein said second film is thermally oxidized at the portions thereof residing between said conductive pads.

10. A device in accordance with claim 4, wherein said thin films are deposited by sputtering.

11. A device in accordance with claim 10, wherein said conductive terminal pads comprise metallic gold applied by sputtering.

12. A composite thin film resistor, comprising in combination:

an electrically inert substrate;

a nickel-chromium alloy thin film deposited upon said substrate;

a second thin film being overdeposited upon said nickel-chromium film as metallic tantalum;

at least a pair of conductive terminal pads overlying said second film, said pads being spaced on said substrate, whereby a resistive path is defined through at least portions of said films intervening between said pads; and the portions of said tantalum film extending between the lateral boundaries of said terminal pads being thermally oxidized to render same a stable, relatively inert protective layer contiguous with respect to the underlying nickel-chromium film.

13. A device in accordance with claim 12, wherein said thin films are photo-etched into a resistive pattern extending between said terminal pads.

14. A device in accordance with claim 13, including a plurality of said terminal pads, and a plurality of said resistive patterns extending between each said terminal pair.

15. A device in accordance with claim 13, wherein each said resistive pattern includes a trimming tab portion for enabling adjustment of the resistive value of the said pattern.

* * * * *